US009212553B2

(12) United States Patent
Sollami

(10) Patent No.: US 9,212,553 B2
(45) Date of Patent: Dec. 15, 2015

(54) DIRT AND ROCK CUTTING BIT TOOL

(71) Applicant: The Sollami Company, Carterville, IL (US)

(72) Inventor: Jimmie L. Sollami, Herrin, IL (US)

(73) Assignee: The Sollami Company, Carterville, IL (US)

( * ) Notice: Subject to any disclaimer, the term of this patent is extended or adjusted under 35 U.S.C. 154(b) by 49 days.

(21) Appl. No.: 14/074,816

(22) Filed: Nov. 8, 2013

(65) Prior Publication Data

US 2015/0130258 A1 May 14, 2015

(51) Int. Cl.
*E21C 35/193* (2006.01)
*E21C 35/18* (2006.01)
*B28D 1/18* (2006.01)

(52) U.S. Cl.
CPC ..... *E21C 35/18* (2013.01); *B28D 1/186* (2013.01); *E21C 35/1933* (2013.01); *E21C 2035/182* (2013.01)

(58) Field of Classification Search
CPC ... E21C 35/193; E21C 35/19; E21C 35/1933; E21C 35/197; E21C 2035/182; E21C 35/191; B28D 1/186
USPC ..... 299/106, 107, 110
See application file for complete search history.

(56) References Cited

U.S. PATENT DOCUMENTS 5,007,685 A * 4/1991 Beach et al. ..... 299/85.2
5,088,797 A 2/1992 O'Neill
5,303,984 A 4/1994 Ojanen
5,318,351 A * 6/1994 Walker ..... 299/106
5,374,111 A 12/1994 Den Besten et al.
5,415,462 A 5/1995 Massa
5,725,283 A 3/1998 O'Neill
5,769,505 A 6/1998 Siddle et al.
5,833,323 A 11/1998 Massa et al.
5,884,979 A 3/1999 Latham
5,992,405 A * 11/1999 Sollami ..... 125/36
6,000,153 A 12/1999 Sollami
6,113,195 A 9/2000 Mercier et al.
6,234,579 B1 5/2001 Montgomery, Jr.
6,244,665 B1 6/2001 Bise et al.
6,364,420 B1 * 4/2002 Sollami ..... 299/106
6,371,567 B1 4/2002 Sollami
6,478,383 B1 11/2002 Ojanen et al.
6,585,327 B2 7/2003 Sollami
6,786,557 B2 9/2004 Montgomery, Jr.
7,165,922 B2 1/2007 Inuzuka
7,270,379 B2 9/2007 Stehney
8,142,097 B2 * 3/2012 Ohmura et al. ..... 403/90
8,201,893 B1 6/2012 Sollami (Continued)

*Primary Examiner* — Sunil Singh
*Assistant Examiner* — Michael Goodwin
(74) *Attorney, Agent, or Firm* — Pitts & Lake, P.C.

(57) ABSTRACT

A dirt and rock cutting tool includes a cutting bit mounted on a bit holder. The cutting tool is secured to a bit holder in a manner that allows infinite rotational positioning of the cutting bit but substantially prevents rotation of the cutting bit once secured to a bit holder. The bit holder includes a planar shoulder and a shank extending from the planar shoulder. Shank has a terminal end which includes a threaded bore member. The bit holder includes a receiver dimensioned for receiving the shank. At least one hardened pin member is carried by the bit holder. At least a portion of the tip of the hardened pin extends beyond the surface of the shoulder. Upon securing the bit holder to the bit block, the hardened pin is pulled into the softer metal of the bit block, substantially preventing rotation of the bit holder within the bit block.

14 Claims, 4 Drawing Sheets

(56) References Cited

U.S. PATENT DOCUMENTS 8,302,515 B2 11/2012 Travez et al.
8,894,155 B2 * 11/2014 Elfgen ..... 299/106
2009/0261646 A1 * 10/2009 Ritchey et al. ..... 299/106
2012/0068527 A1 * 3/2012 Erdmann et al. ..... 299/106

* cited by examiner

DIRT AND ROCK CUTTING BIT TOOL

BACKGROUND

1. Field of Invention

This invention pertains to a cutting bit for use in mining, construction, and road surface removal. More particularly, this invention relates to a cutting bit including at least one substantially conical or frustoconical carbide or steel pin member for engaging the cutting bit tool holder in order to prevent unwanted rotation of the cutting bit tool with respect to the tool holder.

2. Description of the Related Art

It is well known in the mining, construction/earth moving, and road removal industries to use cutting bits on the perimeter and across the width of a rotary drum, or continuous chain or the like. In this regard, the cutting bits are mounted on bit holders which are in turn mounted on the drum or the chain. These cutting bits are then moved through an orbit and engage the ground, a mine face, or a road surface for the purpose of removing a portion of the surface of these environments. The cutting bits frequently include a tip, or other cutting tool, and a shank. The shank is received in a bit holder; which in turn is mounted on the drum or chain of the cutting or mining machine. It is common in the art for the shank to be rotatably received in the bit holder. However, once it is mounted, in the case of certain configurations of cutting bits, rotation of the cutting bit once secured, and during cutting or mining, is undesired.

Typical of the known art for cutting bits in the mining, construction/earth moving, and road removal industries is U.S. Pat. No. 6,371,567, issued to the Phillip A. Sollami, on Apr. 16, 2002; U.S. Pat. No. 5,374,111, issued to Den Besten et al on Dec. 20, 1994; U.S. Pat. No. 5,833,323 issued to Massa et al on Nov. 10, 1998; and U.S. Pat. No. 7,165,922 issued to Inuzuka on Jan. 23, 2007. Because it is known that debris from the cutting process can foul the junction of the bit holder and bit block making removal of the bit holder from the bit block difficult, much of the known art pertains to providing a means for forcibly removing the bit holder from the bit block. Further, it is known in this and other arts to use keys and associated keyways when it is desirable to limit or prevent rotation of a shank received within a bore or receiver. However, it is also known that breakage of a key or fouling of the keyway makes removal of the tool secured in such manner time consuming and necessitates a repair. What is missing in the art is a dirt and rock cutting tool assembly that includes at least one hardened member for engaging the bit block so as to substantially prevent rotation of a cutting bit secured to the bit block.

Accordingly, it is an object of the present invention to provide an improved dirt and rock cutting bit tool that allows infinite rotational positioning of the cutting bit and that substantially prevents rotation of the cutting bit upon securing the cutting bit holder to the bit block.

Another object of the present invention is to provide a dirt and rock cutting bit tool that utilizes at least one hardened pin member carried by one of the bit holder and bit block in such a manner that the hardened pin bites into the softer metal of the bit block thereby substantially preventing rotation of the bit holder within the bit block upon securement of the bit holder to the bit block.

Yet another object of the present invention is to provide a dirt and rock cutting tool assembly in which the bit holder is secured to the bit block by means of a single bolt thereby making removal of the bit holder from the bit block less difficult.

BRIEF SUMMARY

According to one embodiment of the present invention, an improved dirt and rock cutting tool assembly that substantially prevents rotation of the cutting bit upon securing the cutting bit to the bit block includes a cutting bit secured to, or otherwise integral with, a bit holder. The bit holder includes a planar shoulder and a shank having a terminal end extending from the planar shoulder of the bit holder. In the preferred embodiment, the terminal end of the shank includes a threaded bore member. The bit block includes a receiver, defined by a bore, having a diameter selected for receiving the terminal end of the shank of the bit holder. The receiver extends through the length of the bit block. In order to secure the bit holder to the bit block, the shank is inserted into the receiver, extending less than the length of the bore. A bolt is threadably received by the threaded bore in the shank.

In order to prevent rotation of the bit holder within the bit block when the bit holder is secured to the bit block, at least hardened one pin member is carried, preferably by the bit holder. In this regard, at least one, preferably blind, bore is disposed on the planar shoulder of the shank. A hardened substantially conical, or frustoconical pin, for example a carbide pin, can be press fit or brazed into the blind bore such that at least a portion of the tip of the hardened pin extends beyond the surface of the shoulder. It will be appreciated that the hardened pin member could also be secured in the blind bore by means of glue or a silicone adhesive or other known methods or adhesives. As the bolt that is threadably received in the threaded bore of the terminal end of the shank is tightened, this hardened pin is pulled into the softer metal of the bit block, thereby biting into the bit block and substantially preventing rotation of the bit holder within the bit block.

In one embodiment, the terminal end of the shank has a selected diameter that is less than the diameter of the portion of the shank in closest proximity to the shoulder of the bit holder. A second planar shoulder is defined by this region of reduced diameter. In an alternate embodiment, the hardened pin is received within a blind bore carried by the second planar shoulder. It will also be appreciated that the hardened pin could be received within a blind bore carried by the planar end of the bit block that engages the shoulder of the bit holder.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION

Figure 1:
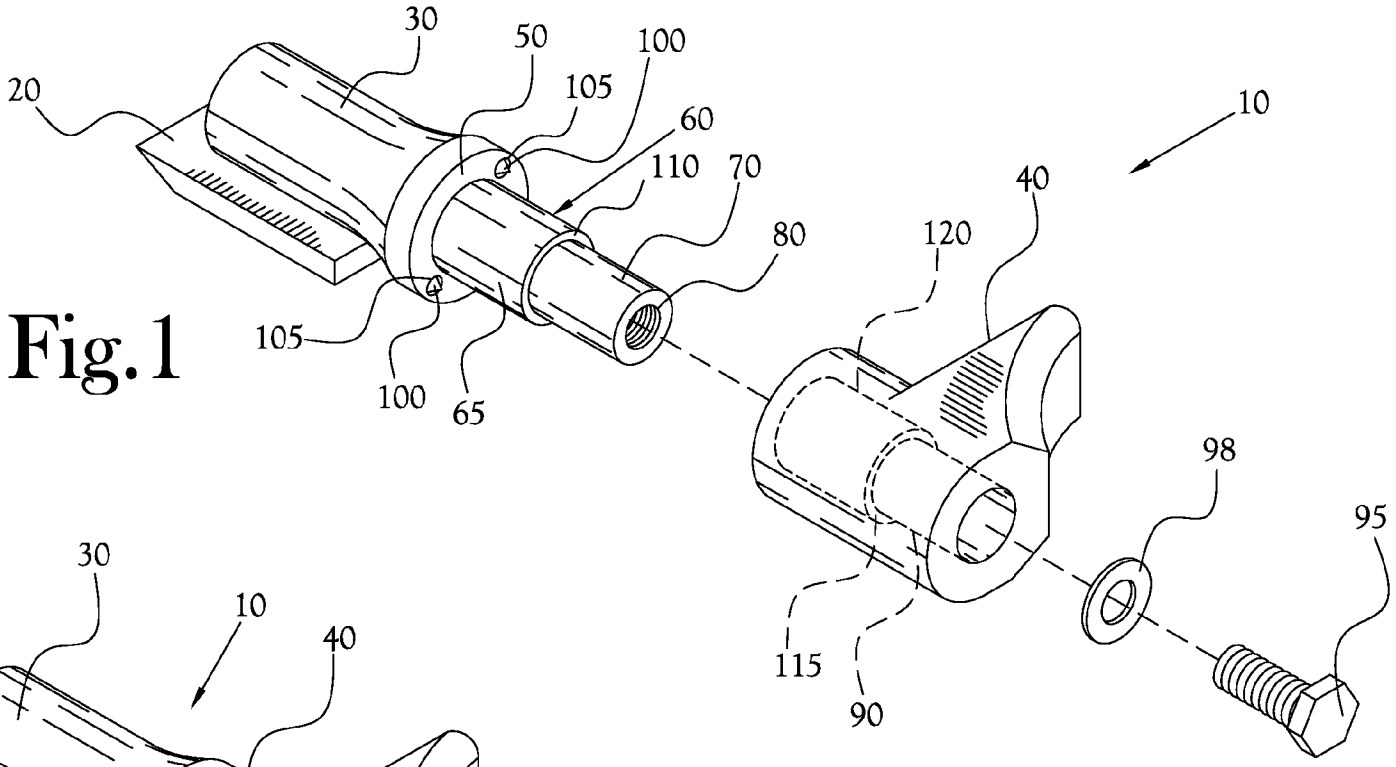
FIG. 1 is an exploded perspective view of the dirt and rock cutting tool assembly of the present invention.
Figure 2:
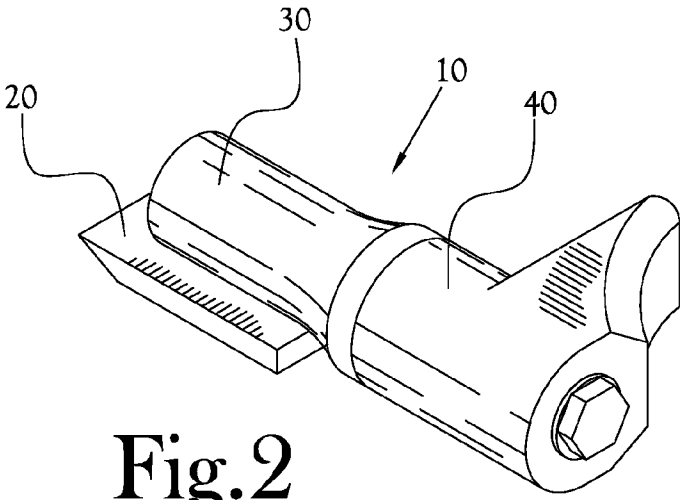
FIG. 2 is an assembled perspective view of the dirt and rock cutting tool assembly illustrated in FIG. 1.
Figure 3:
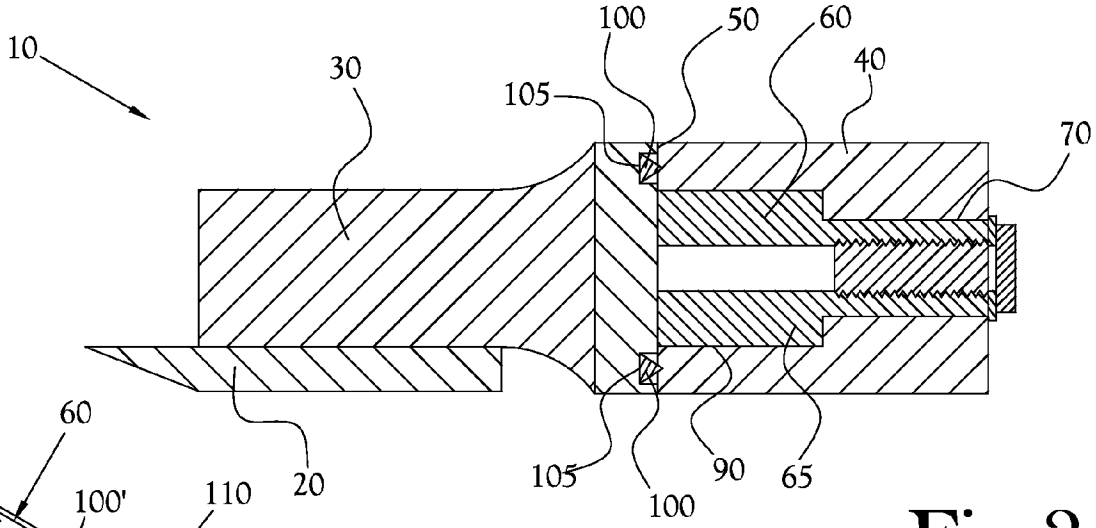
FIG. 3 is cross-sectional view of the dirt and rock cutting tool assembly illustrated in FIG. 1.

Referring to FIGS. 1-3, an improved dirt and rock cutting tool assembly, indicated at 10, constructed in accordance with the present invention, includes a cutting bit 20, which is mounted on a bit holder 30, which in turn is secured to a bit block 40. The bit block 40 is one of a plurality of such bit blocks mounted around the outside of a generally circular drum (not shown) or on a movable chain or track (not shown). As will be described in greater detail below, the bit holder 30 is secured to the bit block 40 in a manner that allows infinite rotational positioning of the cutting bit 20 but substantially prevents rotation of the cutting bit 20 upon securing the bit holder 30 to the bit block 40. It will be appreciated that cutting bit 20 is secured to, or otherwise integral with, a bit holder 30.

Figure 4:
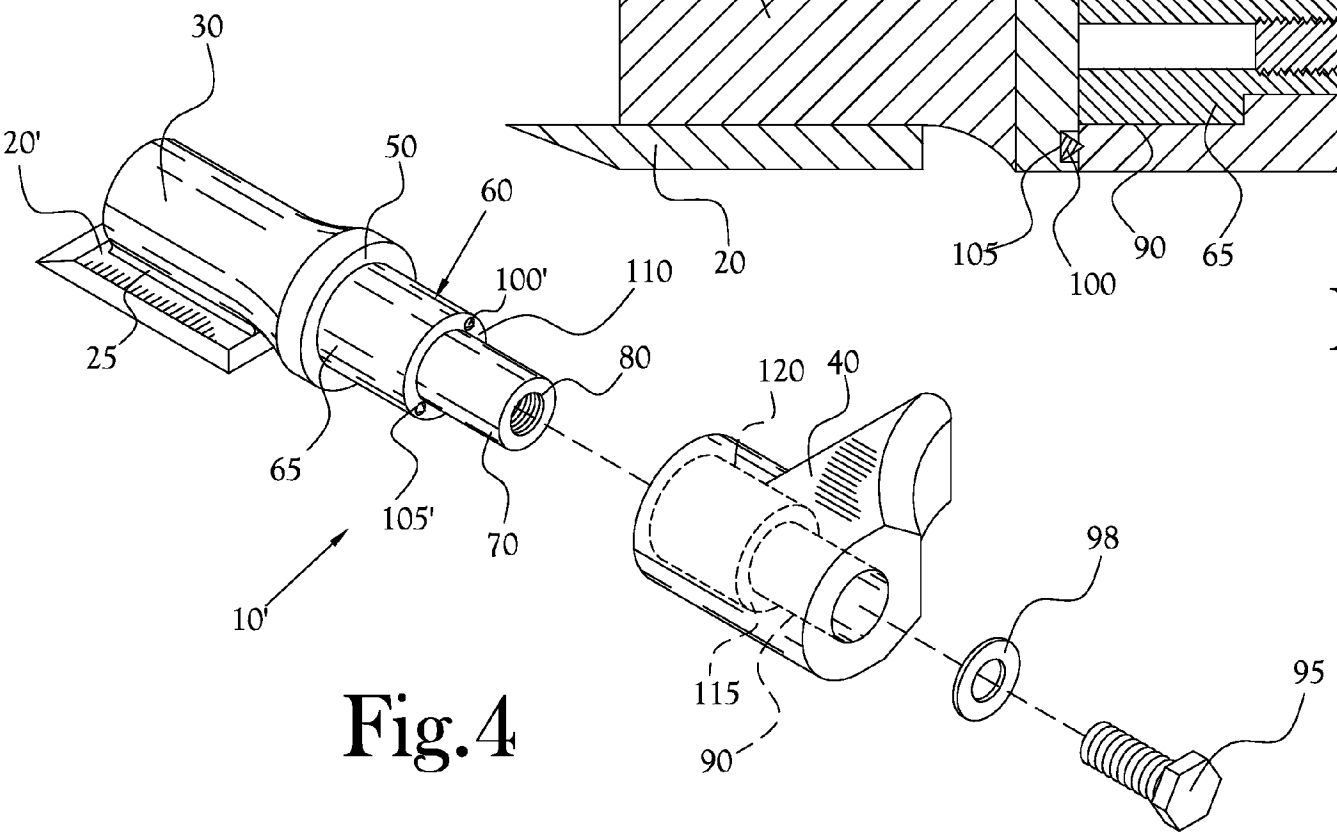
FIG. 4 is an exploded perspective view of an alternate embodiment dirt and rock cutting tool assembly.
Figure 5:
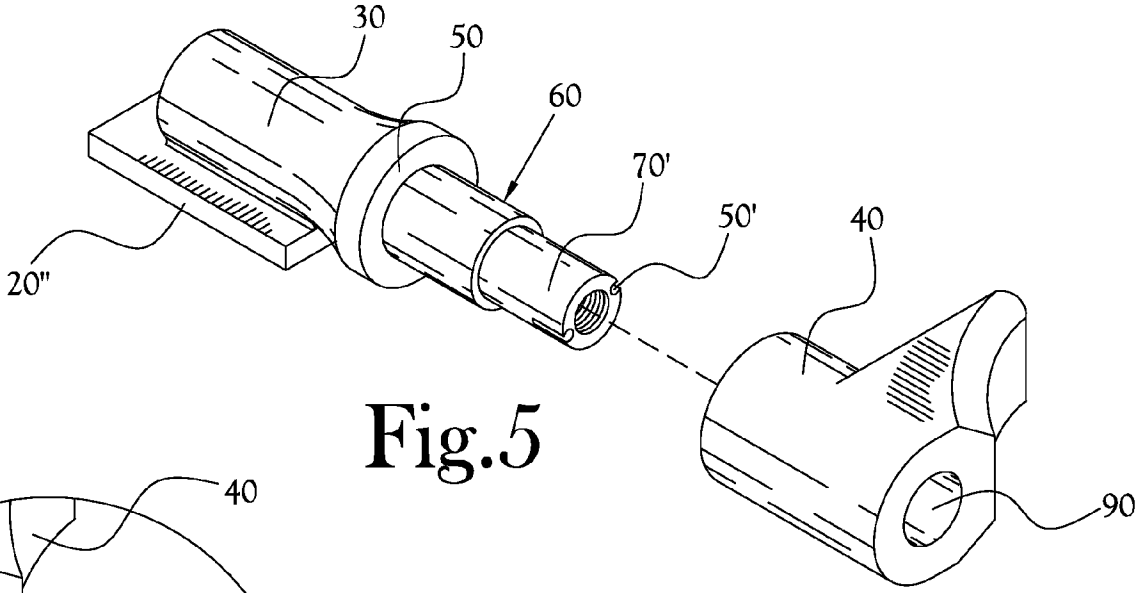
FIG. 5 is an exploded view of an alternate embodiment dirt and rock cutting tool assembly.
Figure 7:
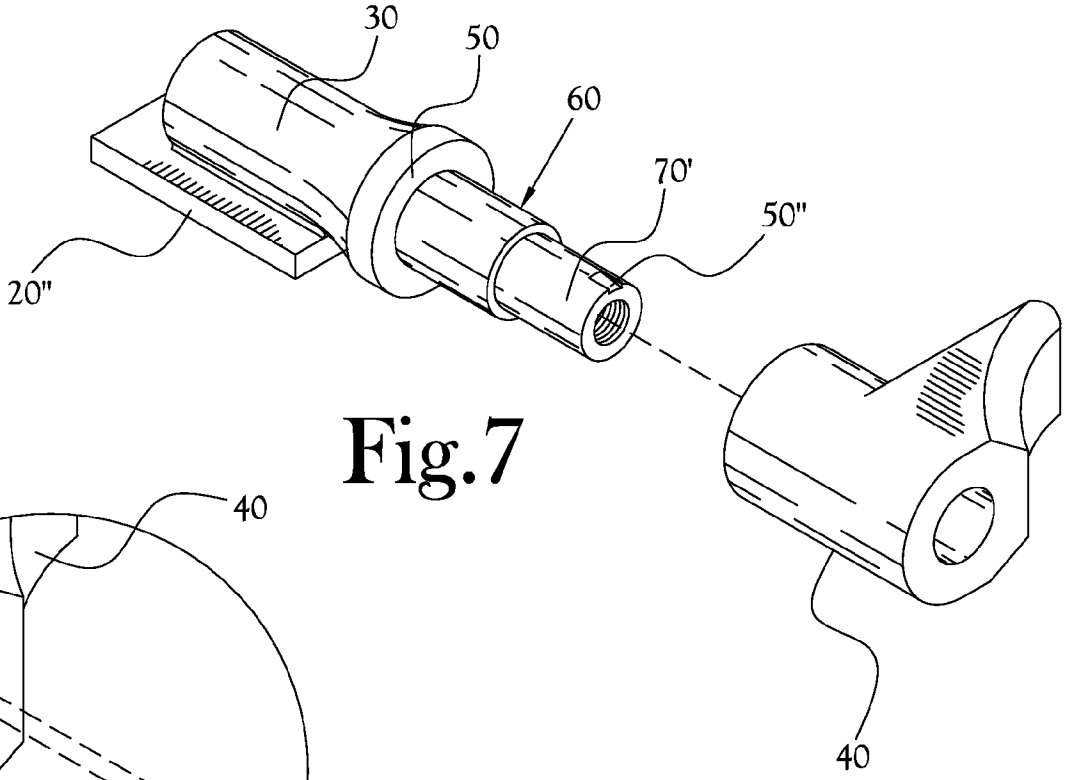
FIG. 7 is an exploded view of an alternate embodiment dirt and rock cutting tool assembly.

It will be appreciated by those skilled in the art, that the cutting bit of the dirt and rock cutting tool assembly 10 can be configured in multiple ways depending on the desired cutting environment, i.e. compacted soil, rocky soil, bedrock consisting of granite, shale, limestone, or admixtures of these types. For instance, the bevel of the cutting edge of the cutting bit 20 can be angled outwardly, as seen in FIG. 1. Alternatively, the bevel of the cutting edge of cutting bit 20' can be angled inwardly, as seen in FIG. 4; or alternately, the cutting bit 20" can be squared off such that there is no bevel, as seen in FIGS. 5 and 7. These modifications to the cutting bit are all within the spirit and scope of the present invention. Moreover, those skilled in the art will recognize that cutting bits, such as cutting bit 20, are subject to wear and breakage. Accordingly, a cutting bit, such as cutting bit 20' in FIG. 4 can be welded, at 25, to the bit holder 30. Or, as illustrated in FIGS. 1-3, cutting bit 20 and bit holder 30 can be integral, either being cast or forged as a single unit or machined as a single unit. The multiple choices of the configuration of the cutting bit, as well as the method of fabrication are all within the spirit and scope of the present invention.

The bit holder 30 includes a planar shoulder 50 and a shank 60 extending from the planar shoulder of the bit holder 30. Shank 60 has a terminal end 70. In the preferred embodiment, the terminal end 70 of the shank 60 includes a threaded bore member 80. The bit block 40 includes a receiver 90, defined by a bore, having a diameter selected for receiving the terminal end 70 of the shank 60 of the bit holder 30. The receiver 90 extends through the length of the bit block 40. In order to secure the bit holder 30 to the bit block 40, the shank 60 is inserted into the receiver 90, extending there through. A bolt 95 is threadably received by the threaded bore 80 in the shank 60. It will be appreciated by those skilled in the art that a washer, such as washer 98, or a combination of washers could also be utilized with bolt 95.

In order to prevent rotation of the bit holder 30 within the bit block 40 when the bit holder 30 is secured to the bit block 40, at least one substantially conical or frustoconical hardened pin member 100 is carried by the bit holder 30. In this regard, at least one, preferably blind, bore 105 is disposed on the planar shoulder 50 of the bit holder 30. The hardened pin 100 is secured in the blind bore 105 such that at least a portion of the tip of the hardened pin extends beyond the surface of the shoulder 50. While brazing is the one method of securing hardened pin member 100 in the blind bore 105, those skilled in the art will recognize that other means of securement could be utilized. For example pin 100 could be press fit into blind bore 105 or an adhesive, such as a glue or a silicone-based adhesive could also be utilized. In the preferred embodiment, hardened pin 100 is fabricated from tungsten carbide. Hardened pin member 100 could also be fabricated from steel or any other material known to be harder than the material from which the bit block 40 is fabricated. As the bolt 95 that is threadably received in the threaded bore 80 of the terminal end 70 of the shank 60 is tightened, hardened pin 100 is pulled into the softer metal of the bit block 40, thereby biting into the bit block 40 and substantially preventing rotation of the bit holder 30 within the bit block 40. While hardened pin 100 is preferably fabricated from tungsten carbide or steel, it will be appreciated by those skilled in the art that pin 100 can be fabricated from any material that is harder and less deformable than the material from which the bit block 40 is constructed.

In one embodiment, the terminal end 70 of the shank 60 has a selected diameter that is less than the diameter of the portion 65 of the shank 60 in closest proximity to the shoulder 50 of the bit holder 30. A second planar shoulder 110 is defined by this region of reduced diameter. And, receiver 90 is provided with a counter-sink region 120 in communication with receiver 90. In this regard, the diameter of receiver 90 is selected to receive terminal end 70 of the shank; and counter-sink region 120 has a second selected diameter selected to receive the portion 65 of the shank 60 in closest proximity to the shoulder 50. A shoulder 115 is thus defined at the junction of the counter-sink region 120 and the receiver 90. In an alternate embodiment dirt and rock cutting tool assembly, referenced as 10' and illustrated in FIG. 4, the hardened pin 100' is received within a blind bore 105' carried by the second planar shoulder 110 and engages shoulder 115 disposed within bit block 40. While not illustrated, it will be appreciated by those skilled in the art that the hardened pin could be received within a blind bore carried by the planar end of the bit block that engages the shoulder of the bit holder.

Figure 6:
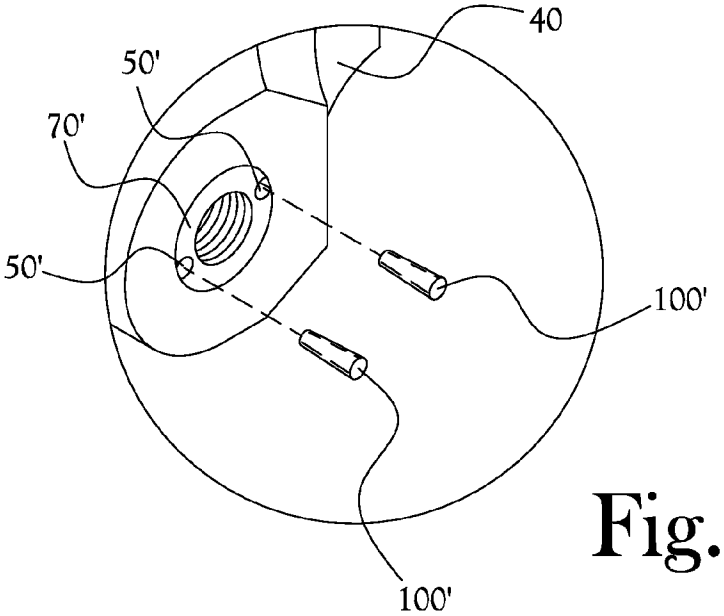
FIG. 6 is a close-up assembled view of a portion of the alternate embodiment dirt and rock cutting tool assembly illustrated in FIG. 5.
Figure 8:
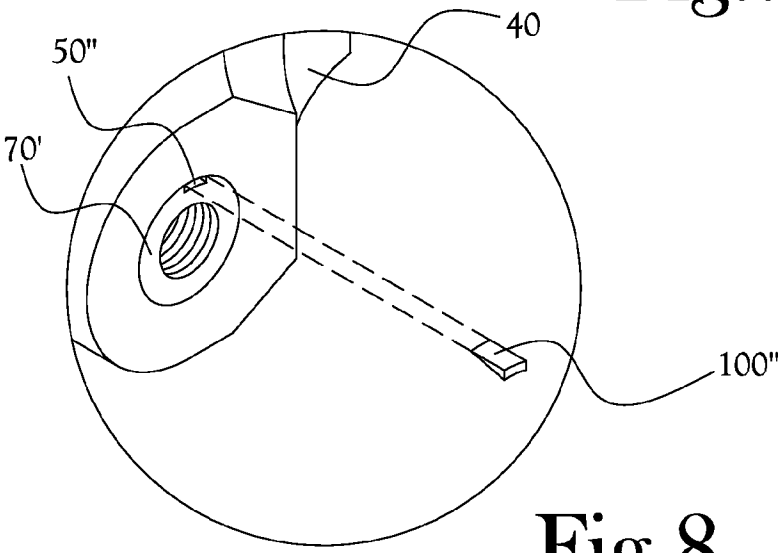
FIG. 8 is a close-up assembled view of a portion of the alternate embodiment dirt and rock cutting tool assembly illustrated in FIG. 7.

Referring to FIGS. 5 and 6, in an alternate embodiment of the dirt and rock cutting tool of the present invention, hardened pin member 100' is adapted to be received by blind bore 50' after the bit holder 30 is received by bit block 40. In this regard, blind bore 50' is disposed on and transects the outer diameter of the terminal end 70' of the shank 60. Upon insertion of the shank 60 into the receiver 90 of the bit block 40 hardened pin member 100' is swaged, or forced, into blind bore 50' and engages both the inner face of the receiver 90 and the terminal end 70' of the shank 60 in a tight frictional fit so as to substantially prevent rotational movement of the bit holder 30 in relation to the bit block 40. Alternatively, as illustrated in FIGS. 7 and 8, blind bore 50" is defined by a groove could be disposed within the terminal end 70' of the shank 60. As described above, the terminal end 70' of the shank 60 would be received by the receiver 90 of the bit block 40. Then, in order to substantially limit rotational movement of the bit holder 30 within the bit block 40, a hardened pin member 100" defined by a wedge-shaped member could be pressed into the groove 50" and engage both the terminal end 70" of the shank 60 and the body of the bit block 40 in a tight frictional fit. At least one hardened pin member can be adapted to be received by the blind bore disposed on the shank and further adapted to engage at least a portion of the bit block frictionally so as to substantially limit rotational movement of the dirt and rock cutting tool in relation to the bit block. The blind bore can be disposed on a planar shoulder of the bit holder and at least one of the hardened pin members can be received in and secured in the blind bore. The pin member can engage and bite into the bit block upon tightening of the bolt, thereby substantially preventing rotational movement of the bit holder in relation to the bit block.

From the foregoing description, it will be recognized by those skilled in the art that a dirt and rock cutting tool assembly that allows infinite rotational positioning of the cutting bit but substantially prevents rotation of the cutting bit upon securing the bit holder to the bit block, and that offers advantages over the known cutting tools in the art has been provided. In this regard, the dirt and rock cutting bit tool assembly utilizes at least one hardened pin member carried by the bit holder in such a manner that the hardened pin bites into the softer metal of the bit block thereby substantially preventing rotation of the bit holder within the bit block upon securement of the bit holder to the bit block. Further, the dirt and rock cutting tool assembly of the present invention is secured to the bit block by means of a single bolt thereby making removal of the bit holder from the bit block less difficult.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An improved dirt and rock cutting tool device, comprising:

a bit block having an internal bore disposed therein;

a tool bit having a planar shoulder and a shank extending from the planar shoulder of the tool bit wherein said shank has a terminal end with a threaded bore member disposed therein and further wherein said shank has a diameter dimensioned to be received by the internal bore of the bit block, the bit block being configured such that a bolt can be configured to be threadably received by the threaded bore member and such that the bolt can be rotationally tightened against the bit block to secure the tool bit to the bit block; and at least one pin member carried by said planar shoulder and configured to engage and bite into a face of the bit block when the tool bit is secured to the bit block by rotationally tightening the bolt against the bit block to restrict rotational movement of said tool bit in relation to the bit block.

2. The improved dirt and rock cutting tool of claim 1 wherein each of said at least one pin member is received by an aperture disposed on said planar shoulder of said tool bit.

3. The improved dirt and rock cutting tool of claim 2 wherein each of said at least one pin member is secured in said aperture by at least one method selected from a group consisting of press fitting, brazing, welding, gluing, and silicone adhesion.

4. The improved dirt and rock cutting tool of claim 2 wherein a plurality of said pin members are disposed on said planar shoulder of said tool bit.

5. The improved dirt and rock cutting tool of claim 1 wherein a cutting portion of the tool bit is welded to said tool bit.

6. The improved dirt and rock cutting tool of claim 1 wherein a cutting portion of the tool bit is integrally formed on said tool bit.

7. The improved dirt and rock cutting tool of claim 6, wherein the at least one pin member, the cutting portion, and the tool bit are formed as a single integrated unit.

8. The improved dirt and rock cutting tool of claim 1 wherein said at least one pin member is formed from at least one material selected from a group consisting of tungsten carbide and steel.

9. An improved dirt and rock cutting tool assembly which substantially prevents rotation of the dirt and rock cutting tool relative to the assembly, said dirt and rock cutting tool assembly comprising:

a tool bit having a first planar shoulder and a shank having a first diameter extending from the first planar shoulder of the tool bit, the shank having a terminal end defining a second diameter smaller than the first diameter, the terminal end defining a second planar shoulder at the interface of the first and second diameters, the terminal end having a threaded bore member disposed at an end thereof;

a bit block for receiving said tool bit, said bit block including a receiver defined by a bore having a first portion dimensioned to receive the first diameter and a second portion dimensioned to receive the second diameter, said receiver extending through a length of said bit block, the bit block being configured such that a bolt can be configured to be threadably received by said threaded bore member and such that the bolt can be rotationally tightened against the bit block to secure the tool bit to the bit block; and at least one pin member carried by at least one of said first planar shoulder and said second planar shoulder, the at least one pin member being configured to engage and bite into at least a portion of said bit block when the tool bit is secured to the bit block by rotationally tightening the bolt against the bit block to restrict rotational movement of said tool bit in relation to said bit block.

10. The improved dirt and rock cutting tool assembly of claim 9 wherein said at least one pin member is disposed on said first shoulder of said tool bit.

11. The improved dirt and rock cutting tool assembly of claim 10 wherein each of said at least one pin member is received by an aperture disposed on said first planar shoulder of said tool bit.

12. The improved dirt and rock cutting tool assembly of claim 10 wherein a plurality of said pin members are disposed on said first and second planar shoulder of said tool bit.

13. The improved dirt and rock cutting tool assembly of claim 9 wherein said at least one pin member is disposed on said second shoulder of said tool bit and engages a substantially planar shoulder disposed between said first and second portions of the bit block.

14. The improved dirt and rock cutting tool assembly of claim 13 wherein each of said at least one pin member is received by an aperture disposed on said second planar shoulder of said tool bit.

* * * * *